United States Patent [19]

Platti

[11] Patent Number: 5,033,626

[45] Date of Patent: Jul. 23, 1991

[54] ROTATING SHOE ENCLOSURE RACK

[76] Inventor: Rita J. Platti, 8041 Mariners Dr., Apt. 3801, Stockton, Calif. 95209

[21] Appl. No.: 572,507

[22] Filed: Aug. 24, 1990

[51] Int. Cl.[5] ..... A47F 7/00

[52] U.S. Cl. ..... 211/37; 211/78; 211/163

[58] Field of Search ..... 211/37, 34, 36, 78, 211/163, 131

[56] References Cited

U.S. PATENT DOCUMENTS

| | | | |
|---|---|---|---|
| 2,973,867 | 3/1961 | Cohen | 211/37 |
| 3,135,389 | 6/1964 | Farley | 211/37 |
| 3,292,797 | 12/1966 | Berk | 211/163 |
| 4,036,367 | 7/1977 | Stambaugh et al. | 211/37 |
| 4,269,124 | 5/1981 | Rosenthal et al. | 211/163 X |
| 4,838,625 | 6/1989 | Taylor | 211/163 X |

*Primary Examiner*—Carl D. Friedman

*Assistant Examiner*—Sarah A. Lechok

[57] ABSTRACT

The shoe rack includes a stand with a vertical pole in the center, circular layers in sections from the center point and mounted through a center hole on to the vertical pole, and at least one vertical pin through the layers to hold the layers together for rotation. Each layer has pie-type sections with an opening on its outside portion to insert or remove shoes. Each section is sloped downward slightly toward the center and is ridged on the outside bottom portion of each opening to help secure the shoes especially during rotation of the rack. The section angular size may vary in degrees to suit the needs of variation in women's shoe heels. The number of layers may vary to suit the needs of the number of shoes to be stored. The sections are structured so that the toes of the shoes are to be placed toward the center of the section, shoes placed sole to sole, and heels on the outer portion of the section.

1 Claim, 2 Drawing Sheets

ROTATING SHOE ENCLOSURE RACK

BACKGROUND OF THE INVENTION

Several shoe racks and holders have been suggested and commercialized in the past. These includes those on stands, those built into closet walls, those hanging on walls, those placed on closet floors, and other models. For practical purposes, a proper design of a shoe rack is needed. Features of this improved shoe rack would include saving space, easy selection of shoes, stability, durability, and affordability. The design would allow several pairs of shoes to be stored in a minimum space with an emphasis on the simple placement of shoes into the rack as well as the simple removal of shoes from the rack. Improvements are certainly worth considering very carefully. Related problems to shoe display or storage are the need for proper ventilation, which is not achieved when shoes are left in shoe boxes stacked on top of one another. Furthermore, some racks have shoes totally in the open, thereby accumulating dust on them. A practical shoe rack would consider these problems.

BRIEF DESCRIPTION OF THE INVENTION

The present invention relates to a shoe rack which deals with the above described problems of existing shoe racks. According to the present invention, several pairs of shoes could be conveniently stored in a rotating circular rack consisting of plural layers placed on to a post-type pole extending vertically upward from a stabilized base. Each of the layers includes plural sections of a circle, angular sections similar to sections of a pie. Each section has an opening on its outside portion so that shoes may be inserted or removed from the section. Because of the circular design, a number of pairs of shoes may be placed into it, depending on the chosen outer diameter of the circle and the number of sections on each layer. The toes of the shoes are set into each section with the soles facing each other and the heels facing each other. The toes are placed toward the center of the rack; the heels are toward the outer circular portion of the section. Because the toes of shoes take less space than heels, especially in women's shoes, and because the toes have been placed into the inner portion of the section, the space is efficiently utilized. For example, if the circular layer were to be decided into six sections, and each section were to be about five inches in height, and if the layers were to be approximately two feet in diameter, then six layers could easily be mounted on the post of the base. This would mean that thirty-six pairs of shoes could be stored in a relatively small space, two feet in diameter and less than one yard in height.

There are many options to this design. The diameter of the layers could vary to accommodate shoe size. Also the height of the sections could vary. Besides the number of shoes being stored in a relatively small space, the height of the shoe rack would allow for the rack itself to be placed in the closet under blouses, skirts, or other garments not requiring the full vertical length of the closet.

Another advantage of this circular shoe rack is that the rack itself rotates and allows easy selection. Several pairs of shoes may be viewed quickly by simply rotating the rack.

Each section of the rack layer would be sloped slightly downward to help secure the shoes in place, especially when rotating the rack. Also a slight ridge is made on the bottom of the outer opening to hold the heels in place.

The sections may be made at different angles. For example, one section could be 40 or 50 degrees, thereby allowing 80 or 70 degrees for other sections. All of the sections simply angle out from the center of the rack, and the sum of all of the section angles would be 360 degrees. This variation would be efficient, allowing more space for high heels especially required for women's shoes.

This shoe rack would include another convenient option, the choice of the number of layers. Less than twenty pairs of shoes could be stored in just three or four layers, thereby being only about two feet high or less. Later, if needed, other layers could be added to the rack.

Some ventilation is allowed through the openings of the sections. However, the shoes are inside the sections so the problem of dust collection is minimized. The shoes are kept relatively clean; and if seldom used, each shoe could be wrapped in light tissue and then placed into the section.

Each layer is provided with at least one slot through at least one section. This is so that a vertical rod may be inserted through the section layers, thereby allowing two or even all layers to be rotated simultaneously. More than one of these vertical rods may be used.

The material used for the shoe rack would be sturdy, durable, and affordable. The stand would be heavy enough to secure its position for rotation. The section layers would be a lighter weight, thereby minimizing the weight of the entire rack.

All these features should make this invention a very practical shoe rack.

DESCRIPTION OF THE PREFERRED EMBODIMENT

Figure 1:
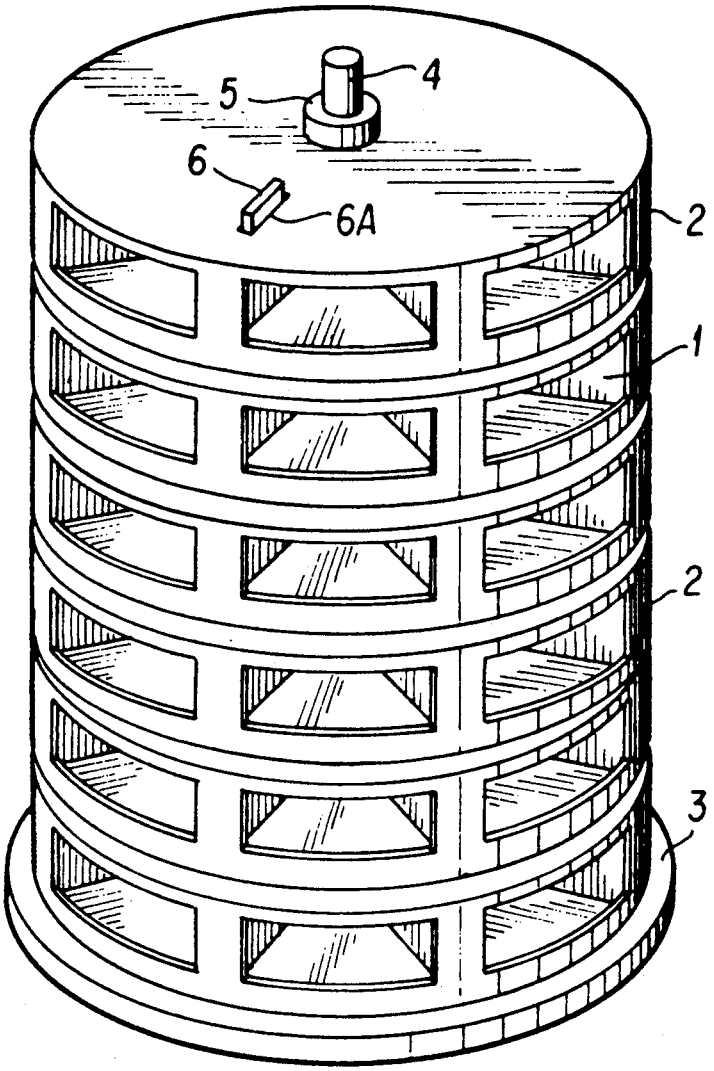
FIG. 1 is an isometric view of the CHOOSE A SHOE rack.

This invention will be referred to as a shoe rack in this description. The openings through which the shoes are inserted are referred to generally in FIG. 1, 2, and 5 by the reference numeral 1.

The circular layers of said rack are referred to generally in FIG. 1, 2, 3, and 5 by the reference numeral 2.

Figure 2:
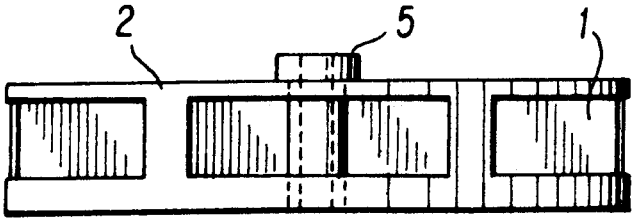
FIG. 2 is a side elevation of one layer of the shoe rack.
Figure 4:
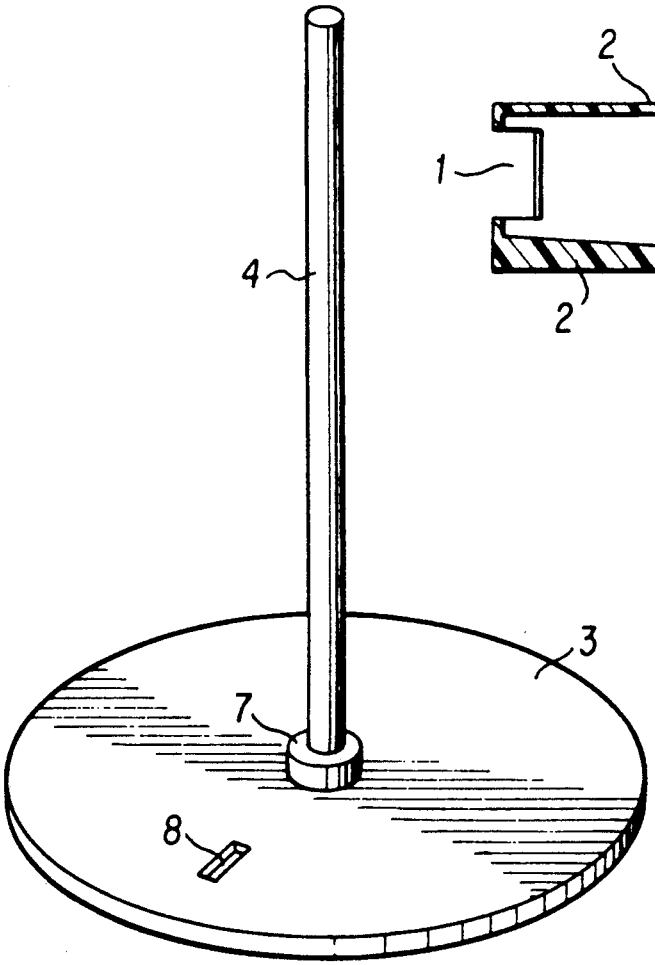
FIG. 4 is an isometric view of the base and vertical pole comprising the stand for the shoe rack.

The base of said rack is referred to generally in FIG. 1 and 4 by the reference numeral 3.

Figure 5:
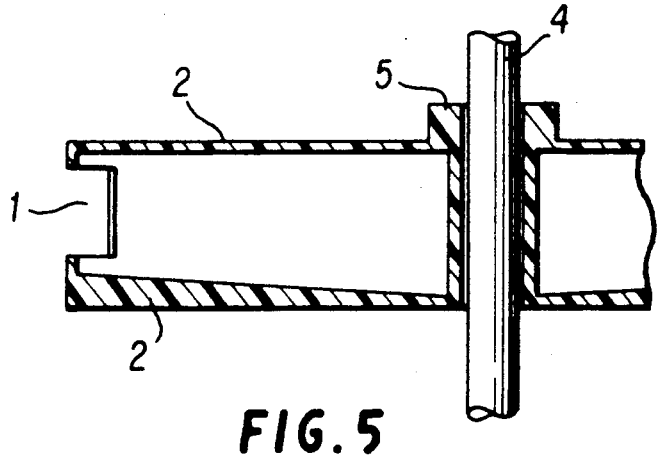
FIG. 5 is an exploded side elevation of one section of one layer of the rack and a portion of the vertical pole.

The vertical pole mounted on said base 3 is referred to generally in FIG. 1, 4, and 5 by the reference numeral 4.

The bearing surfaces upon which the said layers 2 rest or rotate are referred to generally in FIG. 1, 2, 3, and 5 by the reference numeral 5.

Figure 6:
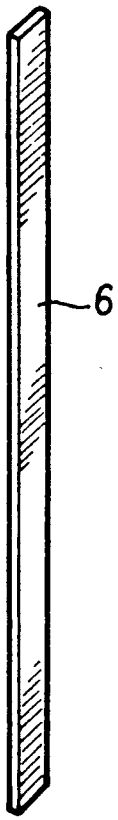
FIG. 6 is an isometric view of the vertical pin used to hold all or some of the sections of the rack together.
Figure 3:
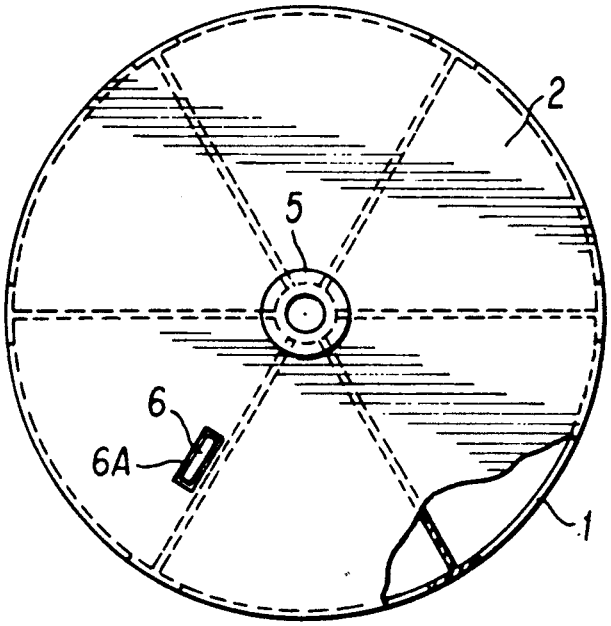
FIG. 3 is a top view of one layer of the rack.

The post inserted through said layers 2 is referred to generally in FIG. 1, 3, and 6 by the reference numeral 6.

One or more slots in said layers 2 are referred to generally by the reference numeral 6A.

The bearing surface upon which the bottom said layer 2 is placed is referred to generally in FIG. 4 by the reference numeral 7.

The slot in said base 3 used to hold said vertical post 6 is referred to generally in FIG. 4 by the reference numeral 8.

This shoe rack description starts with the base 3 as shown in FIG. 4. This said base includes a bearing surface 7 upon which the bottom layer of the shoe rack will rest or rotate. The base 3 has an open slot 8 large enough to receive the vertical post 6, yet tight enough to hold it securely. Said base 3 also has a vertical pole 4 mounted upon its center, large enough and sturdy enough to receive the layers 2 of the rack.

The layers 2 of the rack have a hold in the center large enough to mount on the said vertical pole 4, yet tightly fitted enough to rotate the layer securely. The number of layers 2 to be used is part of the unique quality of this rack. Each layer will hold six pair of shoes; and the number of layers may be chosen by each individual. Additional layers could be added later if so desired until the vertical pole 4 is filled.

The layers 2 comprise six sections into which the shoes are to be inserted. These sections do not necessarily have to be confined to six equal sections. In fact the layer need not necessarily have six sections. However, the general structure of the rack is thus in these drawings. The important part of the structure is that the rack be made of sturdy material, yet light enough so that rotation of the layers is easy and the rack itself may be moved easily.

The rotation of the layers 2 is also a matter of choice. The vertical post 6 is simply a holding device. Said post 6 may be placed through the slot in each layer; and if so chosen, it may be inserted through two layers or all layers down to and into the base 3. This would depend on the variety of lengths of the posts 6 chosen. Not only could the length of the post add to the choice of how many layers would be rotated, structural strength could be added by having more than one slot per layer and move than one vertical post 6. The upper and lower portion of the or more sections of a layer would have an opening 6A through which post 6 would be inserted.

FIG. 5 illustrates the structure of each section 2. Each section must have an opening 1 on the outside large enough to insert the shoes. The bottom of said section 2 is sloped enough to hold the shoes, especially during the rotation of the rack. Also the bottom of 2 has the slight lip at the upper outside part of the slope, to help secure the shoes in place. The bearing surface 5 is part of the rotation structure. The bearing surface must be smooth and durable and could be made of different material than the rest of the section.

FIG. 1, 2, 3, and 5 indicate the general structure of the rack for the placement of shoes. The toes of the shoes are to be placed toward the center of the rack with the soles of the shoes facing each other. The outer part of the section is wider and therefore will be used for the heels of the shoes. Women's shoes with higher heels would require the extra circumference provided at the outside of the section.

The bearing surface 7 could be stronger and wider than bearing surface 5, because bearing surface 7 is part of the base 3. The layers 2 may be rotated on these bearing surfaces.

I claim:

1. A rotatable shoe rack structure comprising a base, said base having a bearing surface, a vertical column centered and supported on said base, a plurality of circular shoe holding layers stacked one above the other centrally on said vertical column and mounted for independent rotation thereon, an optional vertical rod insertable through said layers, each said layer being divided into pie-shaped sections, each said section having a bottom which slopes downwardly and inwardly towards said column thereby accommodating sole-to-sole, heel-to-heel placement of shoes on said bottom, each said section being enclosed on all but one side, said vertical rod being insertable through said layers and being totally or partially removable by lifting upwards through said layers, said rod being of various effective lengths thereby allowing for the rotation of one or more said layers simultaneously.

* * * * *